United States Patent [19]

Raab

[11] Patent Number: 4,623,779

[45] Date of Patent: Nov. 18, 1986

[54] ELECTRICALLY HEATED BRUSH INCLUDING A HEAT DISTRIBUTION BARREL STRUCTURE

[75] Inventor: John J. Raab, Lakewood, N.J.

[73] Assignee: Conair Corporation, Edison, N.J.

[21] Appl. No.: 572,460

[22] Filed: Jan. 20, 1984

[51] Int. Cl.[4] ..... A45D 1/04

[52] U.S. Cl. ..... 219/222; 219/365; 219/226; 132/36 R

[58] Field of Search ..... 219/365, 366, 367, 373, 219/222, 374, 378, 226, 225; 132/36 R, 36 A, 36 AA, 36.1 R, 36.1 A

[56] References Cited

U.S. PATENT DOCUMENTS

| | | | |
|---|---|---|---|
| 3,581,056 | 5/1971 | Djenner | 219/222 |
| 4,327,753 | 5/1982 | Bertschi | 219/222 X |
| 4,492,241 | 1/1985 | Thaler et al. | 219/222 X |

*Primary Examiner*—E. A. Goldberg
*Assistant Examiner*—M. M. Lateef
*Attorney, Agent, or Firm*—Haynes N. Johnson

[57] ABSTRACT

An electrically-heated brush has a barrel formed of a pair of concentric, cylindrical sleeves defining a heat distribution plenum chamber therebetween, and with electrical heating means within the innermost sleeve. The teeth or bristles for the brush are molded on individual tooth bars and fixedly mounted between the two sleeves, with the teeth extending radially through holes in the outer sleeve.

8 Claims, 4 Drawing Figures

ELECTRICALLY HEATED BRUSH INCLUDING A HEAT DISTRIBUTION BARREL STRUCTURE

BACKGROUND OF THE INVENTION

This invention relates to the field of electrically heated brushes, that is, brushes having a heated barrel for treating hair which has radially extending, non-heat-conducting teeth or bristles. Its purpose is to brush or curl hair and, at the same time, subject the hair to mild, not excessive, heat treatment.

Structures of this nature exist, but often include barrels made of extruded aluminum cylinders, at a higher manufacturing cost, and sometimes include no provision for preventing excessively hot spots on the heated barrel which could harm the hair or the skin.

Examples of patents in this field include Walter U.S. Pat. Nos. 3,973,528, Gress 4,217,915, Dorn 4,314,137 and Bertschi 4,327,753.

SUMMARY OF THE INVENTION

This invention is directed to an electrically heated hairbrush which is less expensive to manufacture and provides a temperature moderating plenum chamber to evenly distribute heat from the internal heating element.

In essence, the unit includes a handle (which may be detachable) with an extending barrel and teeth or bristles projecting radially outwardly from the barrel. The barrel is made of concentric inner and outer heat conducting, metallic tubes or sleeves, complementary in shape and spaced a uniform distance apart. These sleeves may, for example, include a chrome-plated steel outer sleeve for best appearance and an inner aluminum sleeve.

The outer sleeve includes a plurality of axially-aligned rows of tooth receiving holes through which the teeth project. The teeth are molded on a plastic tooth bar, having a longitudinally-extending base portion (which fits between the two sleeves) and teeth which extend radially through the holes. There is one bar for each row of holes. The dimensions of the inner sleeve, the outer sleeve and the thickness of the base of the tooth bar are such that the tooth bar will fit between the outer and inner sleeves. The inner sleeve will press the tooth bar against the outer sleeve to make the barrel unitary and hold the teeth in position.

An electric heating element is located inside the inner sleeve. The heat from it passes through the inner sleeve and is then moderated in a heat distribution plenum chamber formed between the inner and outer sleeves. Consequently, the outer sleeve is warmed uniformly and moderately without excessive hot spots.

DETAILED DESCRIPTION OF THE DRAWINGS

DETAILED DESCRIPTION OF THE INVENTION

Figure 1:
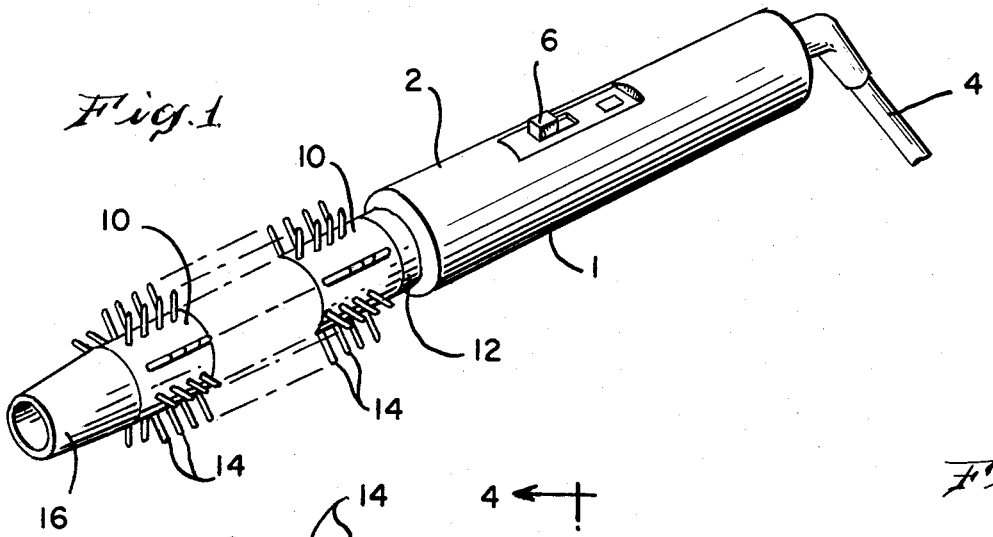
FIG. 1 is a perspective view of a hairbrush of the type of my invention.
Figure 2:
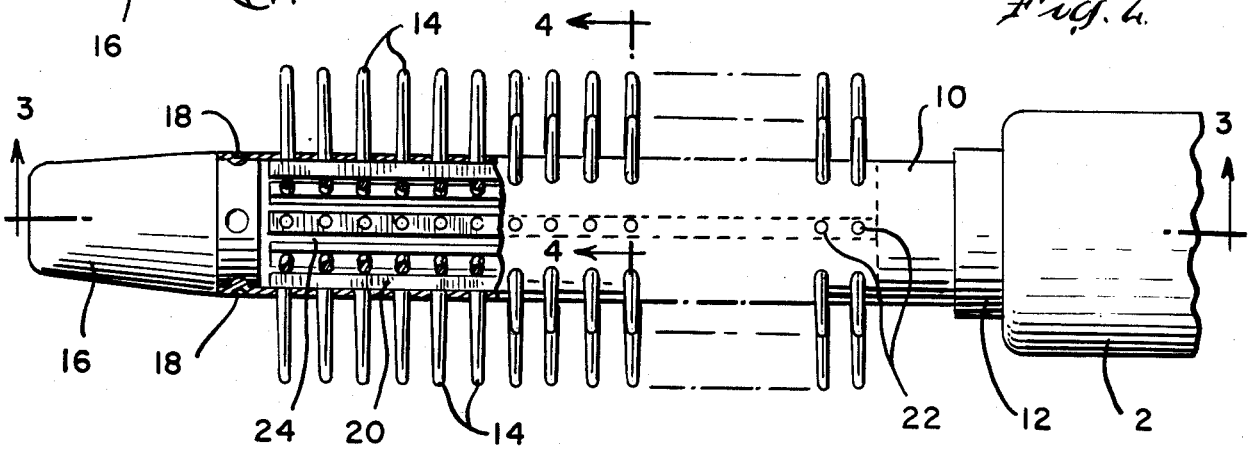
FIG. 2 is a side view of the brush portion which has partially been broken away to show some of the internal construction.
Figure 3:
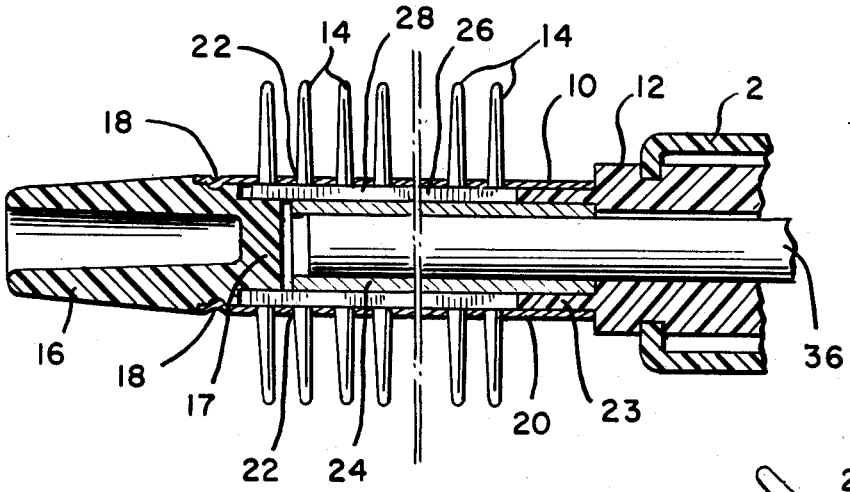
FIG. 3 is a lengthwise slice or section made on line 3—3 of FIG. 2 to show the internal construction of FIG. 2 to show the internal construction of the brush.

FIG. 1 is a perspective view of the hairbrush 1 of my invention, which, to outward appearances, is similar to many now on the market. It includes a handle 2, an electric cord 4, a switch in the handle 6, and a barrel 10 extending from the handle and having teeth or bristles 14 extending radially from the handle. There may be a shoulder 12 between the handle and the barrel which can include, if desired, internal connections so that the barrel and handle can be separated. The outer end of barrel 10 has an end cap or tip 16 secured to the barrel and preferably made of a non-conducting plastic. End cap 16 may include recessed detents 18 so that it may be crimpingly held by depressions in the outer end of the outer sleeve 20 of barrel 10.

Barrel 10 is formed of two concentric sleeves or tubes preferably cylindrical, fitted within one another. These are outer sleeve 20 and inner sleeve 24, both formed of heat-conducting sheet metal. Sleeves 20 and 24 may be secured to handle 2 through the circular projecting adapter spacer 23, which forms an extension of shoulder 12. Spacer 23 fits between sleeves 20 and 24 and secures them. In a somewhat similar manner, end cap 16 has a projecting portion 17 which fits within outer sleeve 20 and the tooth bars 26.

Outer sleeve 20 includes a series of holes 22. These holes run longitudinally (axially) of the barrel 10 and outer sleeve 20 in a series of parallel rows spaced about the circumference. Preferably the holes are uniformly spaced around the circumference, but the rows may extend only partially around the circumference. If desired, the sleeves may be of some shape other than cylindrical, such as half round, with the holes in only a portion of the circumference of the outer sleeve.

Teeth 14 are molded on tooth bars 26. Each bar has a base portion that runs longitudinally of the barrel and a series of teeth or bristles 14 perpendicular to the bar. The number and spacing of the teeth is such that they will fit through and project radially from holes 22 in sleeve 20. The radial thickness of base 28 is such as to give a snug fit between inner sleeve 24 and outer sleeve 20, thus holding the unit assembled and holding the teeth firmly in their projected positions. There should be one tooth bar 26 for each row of holes 22. The tooth bars and teeth are preferably of a non-heat-conducting, molded plastic material.

Sleeves 20 and 24 may be cylindrical or of some other desired shape. The shapes should be complementary and sized such that there is a uniform distance between the sleeves in those areas containing tooth bars. That distance should be such that the base portions are securely held between the sleeves.

Figure 4:
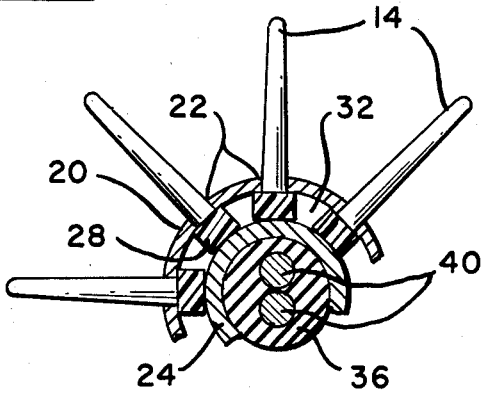
FIG. 4 is a crosswise slice or section of the brush, taken on line 4—4 of FIG. 2, to show further details of the internal construction.

The space between outer sleeve 20 and inner sleeve 24 defines a heat distribution and heat modifying plenum chamber 32 (see, in particular, FIG. 4.)

A heating element 36 of a conventional design, such as a rope heater, and including wires 40, is mounted coaxially within inner sleeve 24 and connected through switch 6 to an electric cord 4.

The barrel portion of the unit is assembled by inserting the tooth bars 26 inside outer sleeve 20 and having the teeth 14 project through holes 22. The inner sleeve 24 is then slipped into place inside the bases 28 of tooth bars 24 providing a snug fit to hold the teeth in position. Heating element 36 may then be positioned inside sleeve 24. Adapter spacer 23 is fitted between the inner and outer sleeves to hold the assembled barrel to shoulder 12 and to handle 2. End cap 18 is then positioned and the ends of outer sleeve 20 crimped or staked into detents 18 to hold it in position.

As can be seen, this construction provides an air space between outer sleeve 20 and inner sleeve 24, identified as plenum chamber 32. Consequently, heat from heating element 36 is radiated to the surface of inner sleeve 24 and conducted through it. The heat then diffuses in the air space of plenum 32 to outer sleeve 20. As a result, it uniformly heats outer sleeve 20, but at the same time, prevents the more intense heat level found at inner sleeve 24 from contacting the skin or hair. By this means protection is had against overheating the outer sleeve and so possibly burning the user's skin or scorching the user's hair.

If desired, the barrel made up of inner and outer sleeves, the tooth bars and teeth, and the electrical heater may be assembled as an integral unit detachable from the handle. In such design proper electrical connections will be required between the barrel and handle to permit connection and disconnection.

What is claimed is:

1. An electrically heated brush for treating hair without presenting excessive heat to the skin or hair, said brush including a handle, a longitudinally extending outer sleeve secured to said handle at one end of said sleeve, said sleeve having a plurality of axially-aligned rows of tooth-receiving holes, a tooth bar for each said row, each said bar including a longitudinally extending base portion and radially-extending teeth, said bar being positioned within said outer sleeve and with said teeth passing radially outwardly through said holes, an inner sleeve within said outer sleeve and said tooth bars, dimensioned to pressingly engage said bars between said inner and outer sleeves to hold same in fixed position within said outer sleeve with said teeth extending radially, said inner and outer sleeves defining a heat distribution plenum therebetween, and electrical heating means positioned within said inner sleeve.

2. A brush as set forth in claim 1 in which said inner and outer sleeves are cylindrical.

3. A brush as set forth in claim 2 in which axially-aligned rows are spaced uniformly about the circumference of said outer sleeve.

4. A brush as set forth in claim 1 in which said electrical heating means is a rope heater.

5. A brush as set forth in claim 1 in which said inner and outer sleeves, said tooth bars and said electrical heating means form an integral unit detachably secured to said handle and said handle includes an electrical swtich connected to and controlling said electrical heating means.

6. A barrel structure for use in a heated brush and adapted to provide safe and uniform heating, said barrel including an outer sleeve and an inner sleeve of complementary shape, said outer sleeve including a plurality of axially-aligned rows of tooth-receiving holes, a tooth bar for each said row, each said bar including an axially-extending base portion and radially-extending teeth, the radial width of said base portion being dimensioned for snug fit between said sleeves, said tooth bar being fixedly positioned between said inner and outer sleeves with said teeth extending radially outwardly, a heating element within said inner sleeve and said inner and outer sleeves defining a plenum chamber therebetween for heat diffusion.

7. A barrel structure as set forth in claim 6 in which said sleeves are cylindrical.

8. A barrel structure as set forth in claim 6 in which said sleeves are made of sheet metal.

* * * * *